US008155570B2

(12) United States Patent
Sakata

(10) Patent No.: US 8,155,570 B2
(45) Date of Patent: Apr. 10, 2012

(54) DEVELOPING DEVICE AND IMAGE FORMING APPARATUS WITH THE SAME

(75) Inventor: Shoichi Sakata, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 468 days.

(21) Appl. No.: 12/413,863

(22) Filed: Mar. 30, 2009

(65) Prior Publication Data

US 2009/0245886 A1 Oct. 1, 2009

(30) Foreign Application Priority Data

Mar. 31, 2008 (JP) ..... 2008-093214

(51) Int. Cl.
*G03G 15/06* (2006.01)
*G03G 15/08* (2006.01)
*G03G 15/09* (2006.01)

(52) U.S. Cl. ..... 399/270; 399/55; 399/285

(58) Field of Classification Search ..... 399/270, 399/285

See application file for complete search history.

(56) References Cited

U.S. PATENT DOCUMENTS

| | | | | |
|---|---|---|---|---|
| 5,182,601 | A * | 1/1993 | Hodoshima et al. | 399/258 |
| 5,247,333 | A * | 9/1993 | Yamamoto et al. | 399/273 |
| 5,617,190 | A | 4/1997 | Takenaka et al. | |
| 5,832,350 | A * | 11/1998 | Kumasaka et al. | 399/282 |
| 5,991,587 | A * | 11/1999 | Kikuchi | 399/282 |
| 6,668,146 | B2 * | 12/2003 | Folkins et al. | 399/266 |
| 7,103,294 | B2 * | 9/2006 | Kawano | 399/55 |
| 7,221,881 | B2 * | 5/2007 | Do | 399/44 |
| 7,613,417 | B2 * | 11/2009 | Fujishima et al. | 399/270 |
| 7,742,727 | B2 * | 6/2010 | Sakata et al. | 399/270 |
| 7,761,041 | B2 * | 7/2010 | Maeyama et al. | 399/281 |
| 7,826,781 | B2 * | 11/2010 | Fujishima et al. | 399/270 |
| 7,941,080 | B2 * | 5/2011 | Sakata et al. | 399/270 |
| 2005/0158061 | A1 * | 7/2005 | Do | 399/44 |
| 2006/0062606 | A1 * | 3/2006 | Okada | 399/285 |
| 2006/0239702 | A1 * | 10/2006 | Imura | 399/44 |
| 2007/0286647 | A1 * | 12/2007 | Sano et al. | 399/281 |
| 2008/0118279 | A1 * | 5/2008 | Maeyama et al. | 399/281 |
| 2008/0181675 | A1 * | 7/2008 | Fujishima et al. | 399/267 |
| 2008/0206661 | A1 * | 8/2008 | Fujishima et al. | 430/48 |
| 2008/0226320 | A1 * | 9/2008 | Sakata et al. | 399/55 |
| 2008/0226350 | A1 * | 9/2008 | Goto et al. | 399/240 |
| 2008/0232860 | A1 * | 9/2008 | Sakata et al. | 399/270 |
| 2008/0232862 | A1 * | 9/2008 | Fujishima et al. | 399/285 |
| 2008/0292365 | A1 * | 11/2008 | Fujishima et al. | 399/285 |
| 2009/0003855 | A1 * | 1/2009 | Kubo | 399/44 |
| 2009/0067890 | A1 * | 3/2009 | Maeyama et al. | 399/273 |

FOREIGN PATENT DOCUMENTS

| | | |
|---|---|---|
| JP | 6-295123 | 10/1994 |
| JP | 7-114262 | 5/1995 |
| JP | 2008-9178 | 1/2008 |

* cited by examiner

*Primary Examiner* — David Gray
*Assistant Examiner* — David Bolduc
(74) *Attorney, Agent, or Firm* — Smith, Gambrell & Russell, LLP

(57) ABSTRACT

A first bias Vslv is applied to a development roller 22 and a second bias Vmag is applied to a magnetic roller 23 to perform development; after completion of development, without changing the setting of Vslv, of the AC component Vpp2 of Vmag, the peak voltage value Vpp2 (max) at the side with the same polarity as toner is made lower than during a development period and development-residual toner on the development roller 22 is collected to prevent a lateral streak formed on photoconductor drums 1*a* to 1*d* during a non-development period.

8 Claims, 9 Drawing Sheets

DEVELOPING DEVICE AND IMAGE FORMING APPARATUS WITH THE SAME

This application is based on Japanese Patent Application No. 2008-093214 filed on Mar. 31, 2008.

BACKGROUND OF THE INVENTION

1. Field of the Invention

The present invention relates to a developing device that uses a two-component developer containing a magnetic carrier and toner, and that can develop, without contact, an electrostatic latent image on an image carrying member with charged toner alone held by a development roller, and the invention also relates to an image forming apparatus provided with such a developing device, such as a copying machine, facsimile, or printer.

2. Description of Related Art

Conventionally, as a developing system using dry toner in an image forming apparatus employing an electrophotographic process, there are known one-component development that does not use a carrier and two-component development that uses a two-component developer, which charges nonmagnetic toner by use of a magnetic carrier, to develop an electrostatic latent image on an electrostatic latent image carrying member (photoconductor) by means of a magnetic brush formed by toner and a carrier on a development roller.

One-component development is suitable for obtaining high-quality images since the electrostatic latent image on the electrostatic latent image carrying member is not disturbed by a magnetic brush. On the other hand, since an elastic control blade controls the toner layer thickness on the development roller and also charges the toner, the toner adheres to the control blade, and thus nonuniform layer formation and hence image defects may result. Moreover, it is difficult to keep stable charging of the toner.

A one drum color superimposing system in which a plurality of color images are successively formed on a photoconductor is also developed; by superimposing toners precisely on the photoconductor, it is possible to form color images with less color displacement and thereby to obtain high-quality color images. Furthermore, in these days, a tandem system is developed that uses a plurality of photoconductors corresponding to the colors of toners, that forms color images synchronously with the conveyance of a transfer member on the photoconductors, and that superimposes color on the transfer member.

The tandem system, though excellent in high-speed operation, requires electrophotographic process members for different colors to be disposed side by side, and thus may lead to an increased size of the apparatus. To avoid such an increase in size, there is proposed a tandem type image forming apparatus in which an image forming unit, which is made compact by narrowing the intervals between photoconductors, is disposed. In a case of color printing where colors are superimposed in such a way, color toners need to be transmissive, and thus need to be nonmagnetic toners.

Thus, in a full color image forming apparatus, two-component development that charges and conveys toner by use of a carrier is typically employed. However, although two-component development can keep a stable charge amount for an extended period and is suitable for prolonging toner life, the magnetic brush mentioned above may affect image quality.

As a means to solve these problems, a developing system is proposed in which a developer is passed by use of a magnetic roller onto a development roller disposed without contact with a photoconductor, so that toner is transferred to this development roller to form a thin layer of nonmagnetic toner, and a toner image is formed by making the toner fly onto a latent image on the photoconductor under an AC electric field.

With this technology, since two-component development as described above is employed in a toner charging area, with toner long-life taken into consideration, and one-component development that make toner alone fly without contact with the photoconductor is employed in a subsequent developing area, with a view to enhancing image quality, it is possible to make use of the respective advantages of one-component development and two-component development.

However, in such a developing system, development failures such as image density failures and uneven images may occur. Thus, with attention paid to the particle size distribution of toner inside the developing device, a method is proposed that prevents degradation in developing performance and image quality.

For example, in JP-A-H6-295123, a method of adjusting toner particle size inside a developing device is proposed that includes: a first step in which nonmagnetic toner is transferred from a magnetic roll to a development roll, under application of a bias between the magnetic roll and the development roll, to form a toner layer on the development roll; a second step in which toner having large particle size and easy to transfer is returned from the toner layer on the development roll to the magnetic roll under application of a bias in a direction opposite to that in the first step; and a third step in which toner having small particle size remaining on the development roll is transferred to an electrostatic latent image carrying member under application of a bias between the development roll and the electrostatic latent image carrying member.

In this way, it is possible to remove toner having large particle size from the toner layer on the development roll, to form a toner layer containing toner having relatively small particle size alone on the surface of the development roll, and to remove the toner having small particle size remaining on the development roller after transferring it to an electrostatic latent image carrying member (photoconductor). Thus, it is possible to keep the particle size distribution of toner inside the developing device substantially even, and to keep the initial developing performance and thereby to prevent degradation in image quality.

SUMMARY OF THE INVENTION

However, the method according to JP-A-H6-295123 requires the bias to be changed between the first step and the second step and between the second step and the third step, and is thus troublesome. Moreover, after the completion of development, when the development bias applied to the magnetic roller or the development roller is changed during a non-development period, a variation in the potential difference between the development roller and the photoconductor may occur. If toner remaining on the development roller flies onto a photoconductor due to such a variation in the potential difference, a lateral streak is formed on the photoconductor, which is then transferred to a recording medium; thus an image failure may result in which the image has a lateral streak.

In view of the above problems, an object of the present invention is to provide a developing device that can prevent toner from flying from a development roller onto a photoconductor during a non-development period and can thereby prevent image quality from degrading, and to provide an image forming apparatus employing such a developing device.

To achieve the above object, the present invention provides a developing device provided with: a toner carrying member which is disposed to face an image carrying member and which develops an electrostatic latent image on the surface of the image carrying member; a toner feeding member which forms a toner layer on the toner carrying member by use of a magnetic brush; a first bias application device which applies a first bias composed of DC and AC components to the toner carrying member; and a second bias application device which applies a second bias composed of DC and AC components to the toner feeding member, the second bias being settable independently of the first bias. Here, a two-component developer containing at least a carrier and toner is used, and the first and the second bias application device apply the first and the second bias as development biases to the toner carrying member and the toner feeding member so as to develop the electrostatic latent image on the surface of the image carrying member; during a non-development period, without the first bias of the first bias application device being changed from during a development period, of the AC components of the second bias of the second bias application device, the peak voltage value at the side with the same polarity as the toner is made lower than during the development period so as to collect the development-residual toner on the toner carrying member onto the toner feeding member.

With this design, in the developing device that develops an electrostatic latent image on the surface of the image carrying member from the toner carrying member by use of a two-component developer and by applying development biases that are being settable independently to the toner carrying member and the toner feeding member, the development-residual toner on the toner carrying member is collected onto the toner feeding member, without the first bias being changed between during a development period and during a non-development period, by making the peak voltage value at the side with the same polarity as the toner of the AC components of the second bias lower than during the development period.

In this way, after the completion of development, at the time of collecting the development-residual toner on the toner carrying member, no variation occurs in the first bias by a change from during a development period to during a non-development period and thus no variation occurs in the potential difference between the toner carrying member and the image carrying member; thus, flying of the toner from the toner carrying member to the image carrying member at the time of the change can be prevented. It is therefore possible to prevent the formation of a lateral streak on the image carrying member during a non-development period, and thereby to prevent degradation in image quality.

The invention provides a developing device with the above design in which the second bias application device is electrically connected to ground shared with the first bias application device, and in which the second bias superimposed on the first bias is applied to the toner feeding member.

With this design, the second bias application device is electrically connected to ground shared with the first bias application device, and the second bias superimposed on the first bias is applied to the toner feeding member. This makes it possible to set the first bias and the second bias independently without affecting each other. This makes it easy to set the first and the second bias.

The invention provides a developing device with the above design in which, when the toner amount on the toner carrying member during a development period is the first toner amount and the toner amount on the toner carrying member after collection of the development-residual toner during a non-development period is the second toner amount, of the AC component of the second bias, the peak voltage value at the side with the opposite polarity to the toner is kept within the range not exceeding the leak voltage between the toner feeding member and the toner carrying member, and the peak voltage value at the side with the same polarity as the toner is so adjusted that the ratio of the second toner amount to the first toner amount is equal to or less than a predetermined value.

With this design, of the AC components of the second bias, the peak voltage value at the side with the opposite polarity to the toner is kept within the range not exceeding the leakage voltage between the toner feeding member and the toner carrying member, and on the other hand the peak voltage value at the side with the same polarity as the toner is so adjusted that the ratio of the second toner amount to the first toner amount is equal to or less than a predetermined value. This makes it possible to stably from a toner layer on the toner carrying member, and also makes it possible to sufficiently collect the toner from the toner carrying member and thereby prevent degradation in printing durability and stability.

The invention provides a developing device with the above design in which, of the AC components of the second bias, the peak voltage value at the side with the opposite polarity to the toner is kept at a maximum value within the range not exceeding the leakage voltage between the toner feeding member and the toner carrying member.

With this design, of the AC components of the second bias, the peak voltage value at the side with the opposite polarity to the toner is kept at a maximum value within the range not exceeding the leakage voltage between the toner feeding member and the toner carrying member. This makes it easy for the toner to return from the toner carrying member to the toner feeding member.

Moreover, the invention provides an image forming apparatus employing a developing device with a design as described above.

With this design, by employing a developing device with a design as described above in an image forming device, it is possible to perform image formation in which image failures such as the formation of a lateral streak are prevented.

DETAILED DESCRIPTION OF PREFERRED EMBODIMENTS

Figure 1:
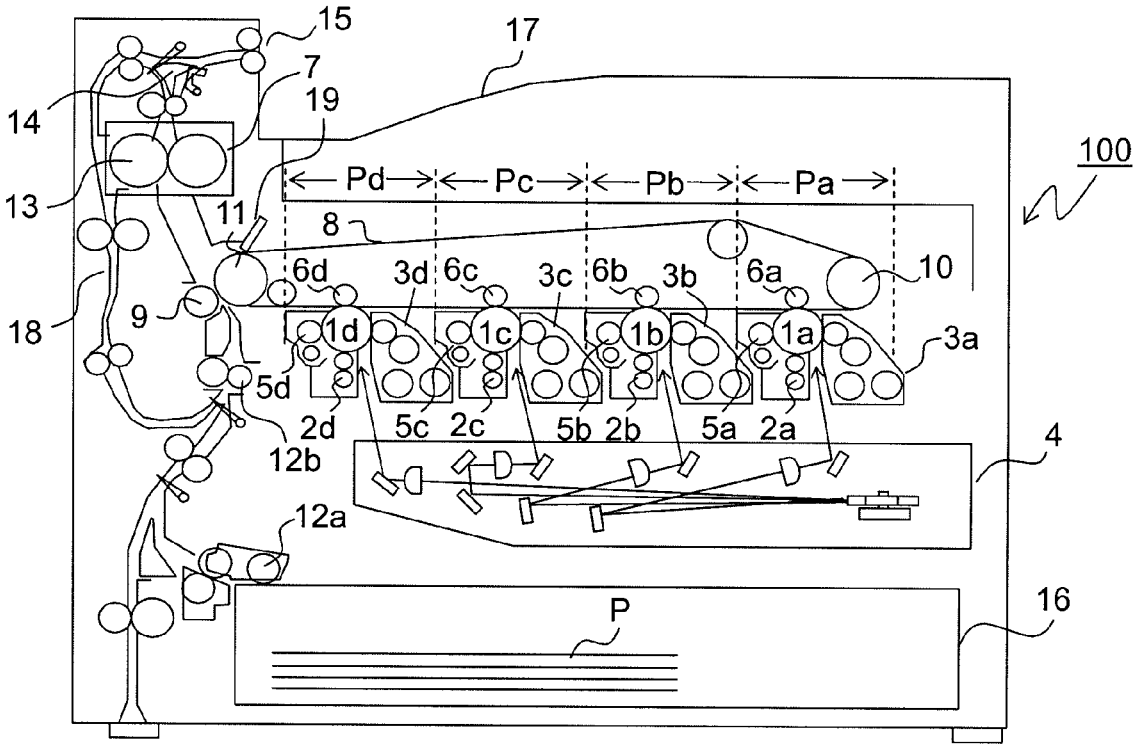
FIG. 1 is a schematic view showing the overall structure of an image forming device incorporating a developing device according to an embodiment of the present invention.

An embodiment of the present invention will be described below with reference to the accompanying drawings. FIG. 1 is a schematic sectional view of an image forming apparatus incorporating a developing device embodying the invention; here, a color image forming apparatus employing a tandem system is shown. Inside the body of the color image forming apparatus 100, four image-forming parts Pa, Pb, Pc, and Pd are successively provided from the upstream side of the conveyance direction (the right hand side in FIG. 1). These image-forming parts Pa to Pd are provided corresponding to images in different four colors (cyan, magenta, yellow, and black), and successively form images in cyan, magenta, yellow, and black, respectively, each through steps of charging, exposing, developing, and transferring.

In the image-forming parts Pa to Pd, photoconductor drums 1*a*, 1*b*, 1*c*, and 1*d* that hold visible images (toner images) in the different colors are disposed; the toner images formed on these photoconductor drums 1*a* to 1*d* are rotated clockwise, as viewed in FIG. 1, by a driving device (unillustrated), and after being transferred successively onto an intermediate transfer belt 8 that moves while remaining adjoining each image-forming part, the toner images are transferred onto transfer paper P at once by a secondary transfer roller 9, and then, after they are fixed on the transfer paper P in a fixation part 7, the transfer paper P is ejected from the apparatus body. The image forming processes for the individual photoconductor drums 1*a* to 1*d* are carried out as the photoconductor drums 1*a* to 1*d* are rotated counterclockwise, as viewed in FIG. 1.

The transfer paper P on which the toner images are transferred is held inside a paper cassette 16 in a lower part of the apparatus and is conveyed to the secondary transfer roller 9 via a feed roller 12*a* and a resist roller pair 12*b*. As the intermediate transfer belt 8, a sheet formed of dielectric resin is used; a continuous belt, which is a sheet with its end parts laid on one another and joined together, or a jointless (seamless) belt is used. On the downstream side of the secondary transfer roller 9, a blade-like belt cleaner 19 for removing the toner remaining on the surface of the intermediate transfer belt 8 is disposed.

A description will now be given of the image-forming parts Pa to Pd. Around and below the photoconductor drums 1*a* to 1*d*, which are disposed to rotate freely, there are provided: charger 2*a*, 2*b*, 2*c*, and 2*d* that charge the photoconductor drums 1*a* to 1*d*; an exposure unit 4 that exposes image information onto each of the photoconductor drums 1*a* to 1*d*; developing devices 3*a*, 3*b*, 3*c*, and 3*d* that form toner images on the photoconductor drums 1*a* to 1*d*; and cleaning parts 5*a*, 5*b*, 5*c*, and 5*d* that remove developer (toner) remaining on the photoconductor drums 1*a* to 1*d*.

When an instruction to start image formation is entered by a user, first, the surfaces of the photoconductor drums 1*a* to 1*d* are charged uniformly by the chargers 2*a* to 2*d*, and are then irradiated with light by the exposure unit 4 to form an electrostatic latent image corresponding to an image signal on each of the photoconductor drums 1*a* to 1*d*. The developing devices 3*a* to 3*d* are filled with predetermined amounts of toners of different colors, i.e., cyan, magenta, yellow, and black respectively, by a replenishment device (unillustrated). The toners are supplied by the developing devices 3*a* to 3*d* onto the photoconductor drums 1*a* to 1*d*, and electrostatically adhere to it to form toner images corresponding to the electrostatic latent images formed by exposure to light from the exposure unit 4.

Then, after an electric field with a predetermined transfer voltage is applied to the intermediate transfer belt 8, by intermediate transfer rollers (primary transfer rollers) 6*a* to 6*d*, the toner images in cyan, magenta, yellow, and black are transferred onto the intermediate transfer belt 8. These four color images are formed with a predetermined positional relationship set in advance with a view to forming a predetermined full color image. Thereafter, the toners remaining on the surfaces of the photoconductor drums 1*a* to 1*d* are removed by the cleaning parts 5*a* to 5*d*, to prepare for the succeeding formation of a fresh electrostatic latent image. The photoconductor drums 1*a* to 1*d* will be described later.

The intermediate transfer belt 8 is stretched between a conveyance roller 10 on the upstream side and a drive roller 11 on the downstream side; when the intermediate transfer belt 8 starts to rotate clockwise as the drive roller 11 is rotated by a drive motor (unillustrated), the transfer paper P is, with a predetermined timing, conveyed from the resist roller 12*b* to the secondary transfer roller 9 provided adjoining the intermediate transfer belt 8, and a full color image is transferred. The transfer paper P having the toner image transferred thereon is conveyed to the fixation part 7.

The transfer paper P conveyed to the fixation part 7 is heated and pressed by a fixation roller pair 13 so that the toner image is fixed on the surface of the transfer paper P to form a predetermined full color image. The transfer paper P having the full color image formed thereon is conveyed in one of a plurality of branch directions provided by a branch part 14. When an image is formed on one side of the transfer paper P, the transfer paper P is ejected as-is to an ejection tray 17 by an ejection roller 15.

On the other hand, when an image is formed on both sides of the transfer paper P, the transfer paper P that has passed the fixation part 7 is branched to a paper-conveyance path 18 in the branch part 14 to be conveyed back to the secondary transfer roller 9 with the image side turned over. Then, the next image formed on the intermediate transfer belt 8 is transferred to the side of the transfer paper P on which no image has been formed by the secondary transfer roller 9, and after the transfer paper P is conveyed to the fixation part 7 to fix the toner image, it is ejected to the ejection tray 17.

An α-Si photoconductor, an OPC, or the like may be used for the photoconductor drums 1*a* to 1*d*. When an α-Si photoconductor is used as a photoconductive material of the photoconductor drums 1*a* to 1*d*, though it has a characteristic of its surface potential after exposure being 20 V or below, which is very low, if its coating thickness is made small, the saturation charge potential is decreased, and the withstand voltage at which insulation breakdown occurs is decreased. On the other hand, the charge density on the surface of the photoconductor drums 1*a* to 1*d* at the time of latent image formation is increased, and thus the developing performance tends to be enhanced.

In an α-Si photoconductor having a high dielectric constant of approximately 10, this characteristic is particularly notable when the coating thickness is 25 μm or less, and further preferably 20 μm or less. Alternatively, when a positive charge OPC (positive OPC) is used as the photoconductor drum 1*a*, because the generation of ozone etc. is small with the positive charge OPC, charging is stable. In a single-layer positive OPC in particular, photoconducting characteristics are less likely to vary even when the coating thickness varies due to long-term use and the image quality is stable; thus it is suitable for systems with long-lives.

To extend the life of the positive OPC, the residual potential needs to be 100 V or less; thus, it is particularly important to set the coating thickness of a photoconductive layer to 25 μm or more to increase the amount in which a charge generation material is added. In the single-layer positive OPC in particular, since the charge generation material is added inside a photoconductive layer, the sensitivity is less likely to vary even when the coating of the photosensitive layer wears, and it is thus advantageous.

When the peripheral speed of the photoconductor drums 1*a* to 1*d* is set at 180 mm/second or more, the processing times of charging, exposing, developing, charge elimination, and the like with respect to the photoconductor drums 1*a* to 1*d* are shortened; thus, it is possible to speed up the printing by the image forming apparatus. However, since the development nip time is shortened, developing properties need to be enhanced, and thus it is important to reduce the adhesion of toner 26 onto the development roller 22.

Figure 2:
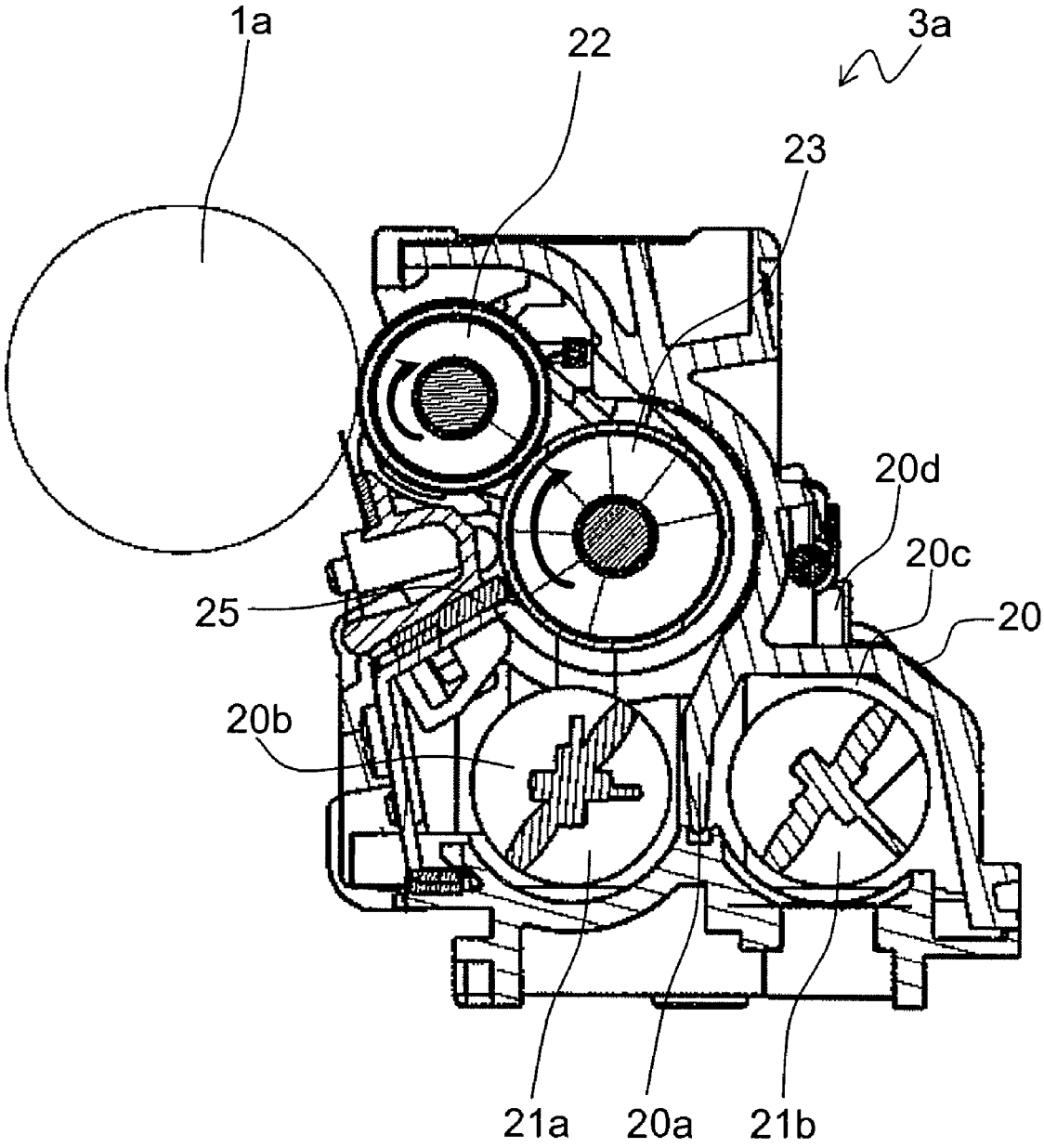
FIG. 2 is a side sectional view showing the structure of the developing device according to the embodiment.

FIG. 2 is a side sectional view showing the structure of a developing device according to this embodiment. Here, a description will be given of the developing device 3*a* disposed in the image-forming part Pa shown in FIG. 1; the structures of the developing devices 3*b* to 3*d* disposed in the image-forming parts Pb to Pd are basically similar, and no description of them will be repeated.

As shown in FIG. 2, the developing device 3*a* is provided with a developer container 20 in which a two-component developer (hereinafter referred to simply as the developer) is contained; the developer container 20 is partitioned into a first and a second agitation chamber 20*b* and 20*c* by a partition wall 20*a*, and in the first and the second agitation chamber 20*b* and 20*c*, a first agitation screw 21*a* and a second agitation screw 21*b* are rotatably disposed that mix toner (positive charge toner), which is fed from an unillustrated toner container, with a carrier and agitate them to charge.

The developer is conveyed in the axis direction as it is agitated by the first agitation screw 21*a* and the second agitation screw 21*b* and circulates between the first and the second agitation chamber 20*b* and 20*c* via an unillustrated developer passage formed in the partition wall 20*a*. In FIG. 2, the developer container 20 extends obliquely left-upward, and a magnetic roller 23 (toner feeding member) is disposed above the first agitation screw 21*a* inside the developer container 20.

A development roller 22 (toner carrying member) is disposed obliquely left-upward of a magnetic roller 23 to face it, and faces the photoconductor drum 1*a* at the open side (the left hand side in FIG. 2) of the developer container 20. The development roller 22 and the magnetic roller 23 rotate clockwise as viewed in the figure. In the developer container 20, an unillustrated toner sensor is disposed to face the second agitation screw 21*b*, and according to the toner concentration detected by the toner sensor, the developer container 20 is replenished with toner from the toner container via a toner replenishment mouth 20*d*.

Figure 3:
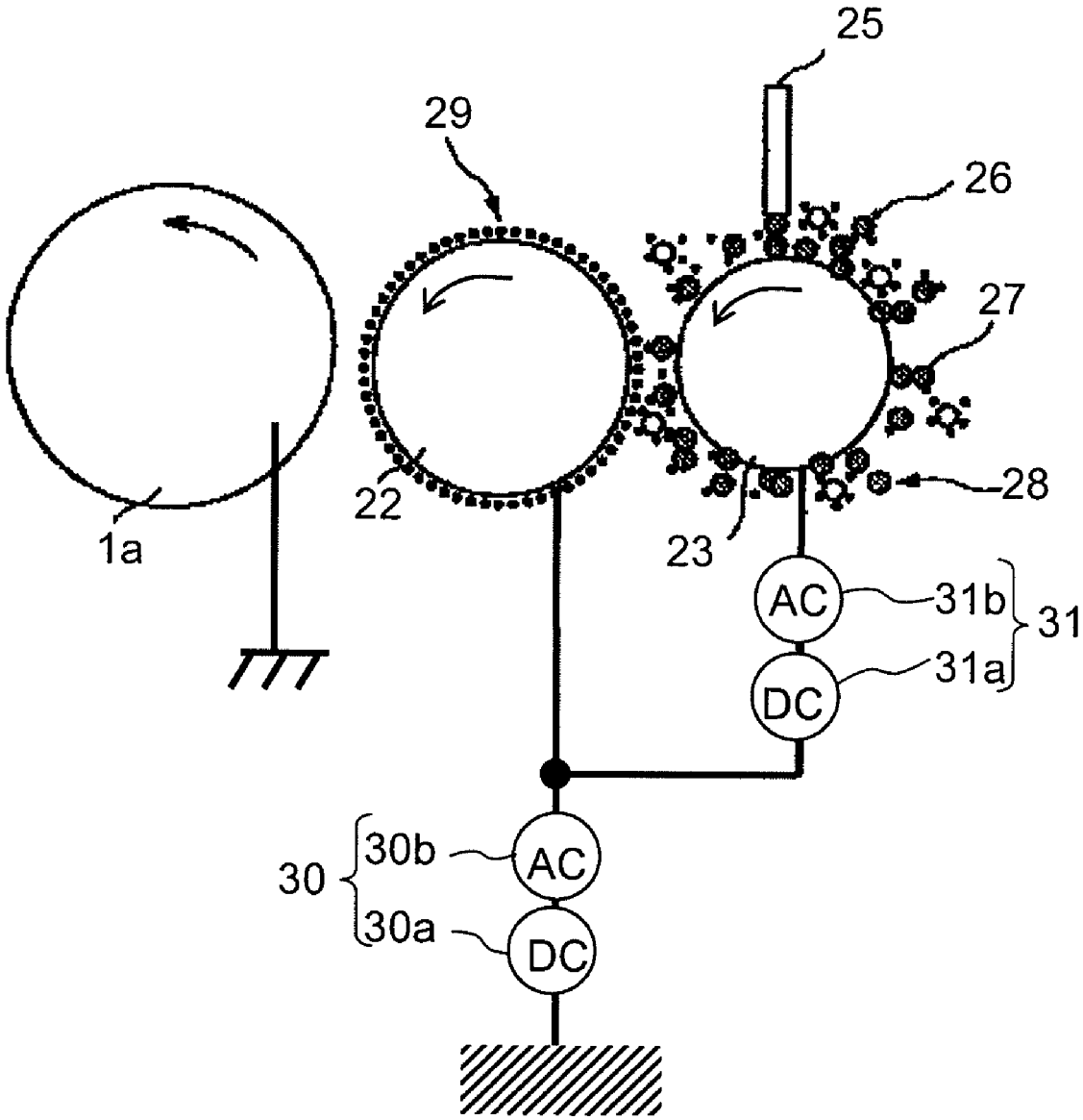
FIG. 3 is a schematic view showing how a first and a second power supply are connected in the developing device according to the embodiment.
Figure 4A:
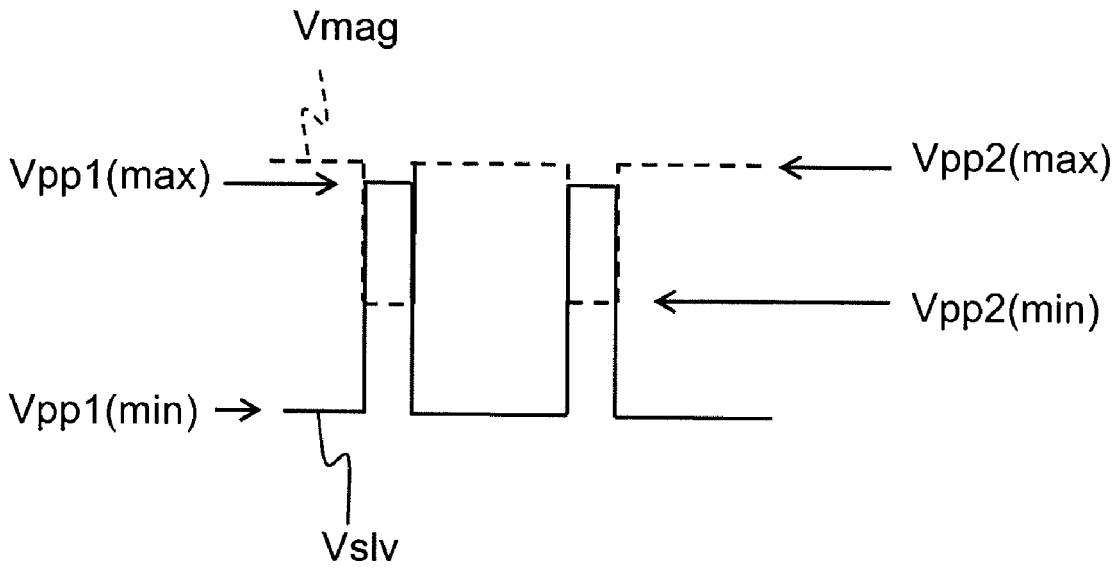
FIG. 4A is a schematic view showing the waveforms of a first and a second bias, respectively, applied to a development roller and a magnetic roller used in the embodiment.
Figure 4B:
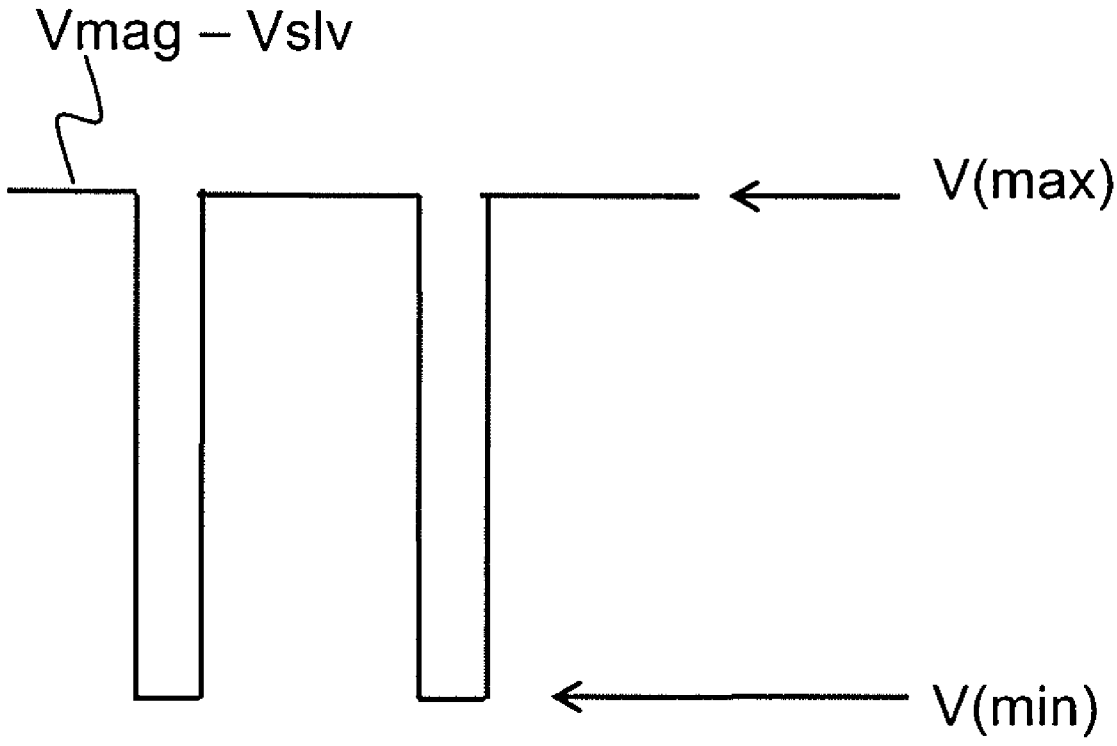
FIG. 4B is a schematic view showing the composite waveform of the first and second biases applied to the development roller and the magnetic roller used in the embodiment.

FIG. 3 is a schematic view showing how a first and a second power supply are connected in the developing device according to this embodiment. FIG. 4A shows the waveforms of a first and a second bias applied to the development roller and the magnetic roller used in this embodiment; FIG. 4B is a schematic view showing the composite waveform of those biases. The developing device will be described in detail below with reference to FIGS. 3 and 4.

It is important to determine the particle size distribution of toner 26 with a view to avoiding selective development. In general, the range of the particle size distribution of toner 26 is measured by use of a particle size distribution analyzer, for example, "Multisizer 3" (manufactured by Beckman Coulter, Inc.), with, for example, an aperture diameter of 100 μm (in a measurement range of 2.0 to 60 μm). The range of the particle size distribution is represented by the ratio between the average particle diameter in terms of volume distribution and the average particle diameter in terms of number distribution. It is important to make the ratio low in order to avoid selective development. When the distribution is wide, the toner 26 with a relatively small particle size accumulates on the development roller 22 during continuous printing, and thus developing properties are degraded.

It is generally well known to make the volume average particle diameter of toner small to improve image quality. On the other hand, it is also known that the influence of the Van der Waals force increases when the volume average particle diameter of toner is made small, and it is therefore difficult to separate the toner 26 from a carrier 27 or remove it off from the surface of the development roller 22. Thus, it is preferable that the volume average particle diameter Dt of the toner 26 be within the range of $4.0\ \mu m \leqq Dt \leqq 7.0\ \mu m$.

When Dt is less than 4.0 μm, the developing properties and the collectivity of the toner from the development roller 22 may worsen due to the adhesion being too strong. Conversely, when Dt is more than 7 μm, it is difficult to reproduce one dot and thus to achieve high image quality. In addition, it is preferable that the CV value of the number particle size distribution of the toner 26 be 25.0% or less. When the CV value is more than 25.0%, the range of particle size distribution is wide, and thus selective development is notable.

The carrier 27 has the functions of collecting the development-residual toner on the development roller 22 after development and of feeding toner thereafter. As the carrier 27, magnetite, Mn type ferrite, Mn—Mg type ferrite, Cu—Zn type ferrite, resin carrier having a magnetic substance dispersed in resin, or the like may be used. Moreover, a carrier with its surface treated within the range not exceeding the appropriate resistance may be used.

In order to remove the toner 26 off, by a magnetic brush 28, that is firmly electrostatically adhered between the development roller 22 and the magnetic roller 23, and to feed the toner 26 required for development, it is preferable that a carrier 27 with a volume specific resistance within the range of $10^6$ Ωcm to $10^{13}$ Ωcm is used. Moreover, by use of a carrier 27 having a weight average particle diameter of 50 μm or less, it is possible to increase the surface area of the carrier 27 and thus to increase contact points with the toner.

The development roller 22 holds a toner layer 29 formed of the toner 26 fed from the magnetic brush 28, and makes the toner 26 fly from the toner layer 29 onto the photoconductor drum 1*a* to develop an electrostatic latent image. The surface of the development roller 22 is composed of a uniformly conductive sleeve formed of aluminum, stainless steel (SUS), conductively coated resin, or the like.

It is possible to secure a leakage margin by coating the surface of the development roller 22 with resin and thereby controlling the resistance. As the resin, it is possible to apply a fluorine resin or resin based on urethane that is highly releasable. Thus, even when a thin-film α-Si photoconductor drum 1*a* with a coating thickness of 20 μm or less is used, it is possible to prevent leakage and thus prevent troubles such as black spots on the photoconductor drum 1*a*.

Moreover, in a case where the toner 26 is of the positive charge type in particular, by using a resin having the same polarity, for example, a resin based on urethane such as a silicone-denatured urethane resin, it is possible to reduce the adhesion of the toner. Thus, the toner 26 can fly easily from the development roller 22, and developing properties are ameliorated. Moreover, the removability (collectivity) of the toner from the development roller 22 to the magnetic roller 23 can be ameliorated. Note that the coating materials and the coating conditions can be set as desired according to the properties etc. of toner, and are not particularly limited.

Let the bias applied to the development roller 22 be called the first bias and the bias applied to the magnetic roller 23 the second bias. To a shaft part of the development roller 22, a first power supply 30 composed of a DC power supply 30*a* and an AC power supply 30*b* is connected, and thus the first bias is applied.

The magnetic roller 23 is a nonmagnetic metal material formed into a rotatable cylindrical shape and has a plurality of stationary magnets provided inside it, and these magnets cause the magnetic brush 28 to be formed by the toner 26 and the carrier 27. The layer thickness of the magnetic brush 28 is regulated by an ear-breaking blade 25. To a shaft part of the magnetic roller 23, the first power supply 30 is connected, and in addition a second power supply 31, which is electrically connected to ground shared with the first power supply 30 and composed of a DC power supply 31*a* and an AC power supply 31*b*, is connected. Thus, the second bias is applied superimposed on the first bias. The first bias and the second bias will be described in detail later.

By the first and the second agitation screw 21*a* and 21*b* inside the developer container 20, the toner fed from the toner container circulates inside the developer container 20 with the carrier as they are agitated; the toner is charged by the friction between the toner and the carrier. The developer is conveyed to the magnetic roller 23 by the second agitation screw 21*b*.

The magnetic brush 28 is formed on the magnetic roller 23 by the developer, and the layer thickness thereof is regulated by the ear-breaking blade 25. The magnetic brush 28 with a predetermined layer thickness makes contact with or come close to the development roller 22, and a toner layer (toner thin layer) is formed on the development roller 22 by the potential difference created between the magnetic roller 23 and the development roller 22 by the first and the second bias. Moreover, by the potential difference between the development roller 22 and the magnetic roller 23, the toner layer 29 is formed on the development roller 22 and undeveloped toner on the development roller 22 is collected onto the magnetic roller 23.

Although the layer thickness of the toner layer 29 on the development roller 22 varies according to the resistance of toner, the difference in rotation speed between the development roller 22 and the magnetic roller 23, and the like, it is possible to control it with the potential difference $\Delta V$ between the development roller 22 and the magnetic roller 23. The toner layer 29 tends to be the thicker the larger $\Delta V$ is and tends to be the thinner the smaller $\Delta V$ is. With these factors taken into consideration the thickness of the above-described toner layer 29 can be set.

The toner on the development roller 22 flies to the photoconductor drum 1*a*, by the potential difference created between the development roller 22 and the photoconductor drum 1*a* under application of the first bias, to be held by an electrostatic latent image formed on the surface of the drum, and thus a toner image is formed. To prevent the toner from scattering, it is preferable that the AC voltage from the first AC power supply 30*b* be supplied immediately before development.

The development-residual toner remaining on the development roller 22, without a special device such as a scraping blade being provided, is collected also by a brush effect, which is produced by the difference in peripheral speed between the magnetic roller 23 and the development roller 22 when the magnetic brush 28 on the magnetic roller 23 makes contact with the toner layer 29 on the development roller 22. The collected toner 26 is agitated by the first agitation screw 21*a* (see FIG. 2), to promote the toner 26 replacement.

Here, since the width of the magnetic brush 28 corresponds to the width over which the toner 26 on the development roller 22 is collected, by making the width of the development roller 22 smaller than that of the magnetic brush 28, it is possible to surely eliminate an area where the toner 26 is not collected. Thus, no toner 26 adheres outside the magnetic brush 28 area on the sleeve of the development roller 22, and thus no toner on opposite end parts of the development roller 22 scatters.

As a method to promote the toner replacement, by setting the rotation speed of the magnetic roller 23 at 1.0 to 2.0 times that of the development roller 22, it is possible to feed the toner having an appropriate concentration setting to the development roller 22 while collecting the toner 26 on the development roller 22. Thus, it is possible to form a uniform toner layer 29.

When $\alpha$-Si is used as the photoconductive material of the photoconductor drum 1*a*, due to the characteristic of the $\alpha$-Si photoconductor described previously, the coating thickness of the photoconductor is preferably 25 μm or less, and further preferably 20 μm or less. In such a case, it is possible to develop, for example, with Vdc1 of the first bias set at 150 V or less, Vpp1 thereof set at 200 to 2000 V, and the frequency set at 1 to 5 kHz. Alternatively, when positive OPC is used as the photoconductive material, to prevent application of a strong electric field to the toner, Vdc1 of the first bias is set preferably at 400 V or less, and further preferably 300 V or less. Moreover, to prevent leakage, it is preferable that Vdc1 and Vpp1 be set at levels where the potential difference from the photoconductor drum 1*a* does not exceed 1500 V.

As shown in FIG. 4A, the first bias has a composite waveform Vslv (the solid line) in which a square wave of the first AC power supply 30*b*, which has a peak-to-peak voltage (AC voltage) Vpp1, a duty ratio Dslv, and a frequency f, is superimposed on the DC voltage Vdc1 of the first DC power supply 30*a*. On the other hand, the second bias has a composite waveform Vmag (the broken line) in which a square wave of the second AC power supply 31*b*, which has a peak-to-peak voltage (AC voltage) Vpp2, a duty ratio Dmag, and a frequency f2, is superimposed on the DC voltage Vdc2 of the second DC power supply 31*a*.

The duty ratio Dslv is the duty ratio at the side (the side with the same polarity as the toner) at which the toner 26 is made to fly from the development roller 22 to the photoconductor drum 1*a*, and the duty ratio Dmag is the duty ratio at the side (the side with the same polarity as the toner) at which the toner 26 is made to fly from the magnetic roller 23 to the development roller 22. Next, the duty ratios will be described.

Figure 5:
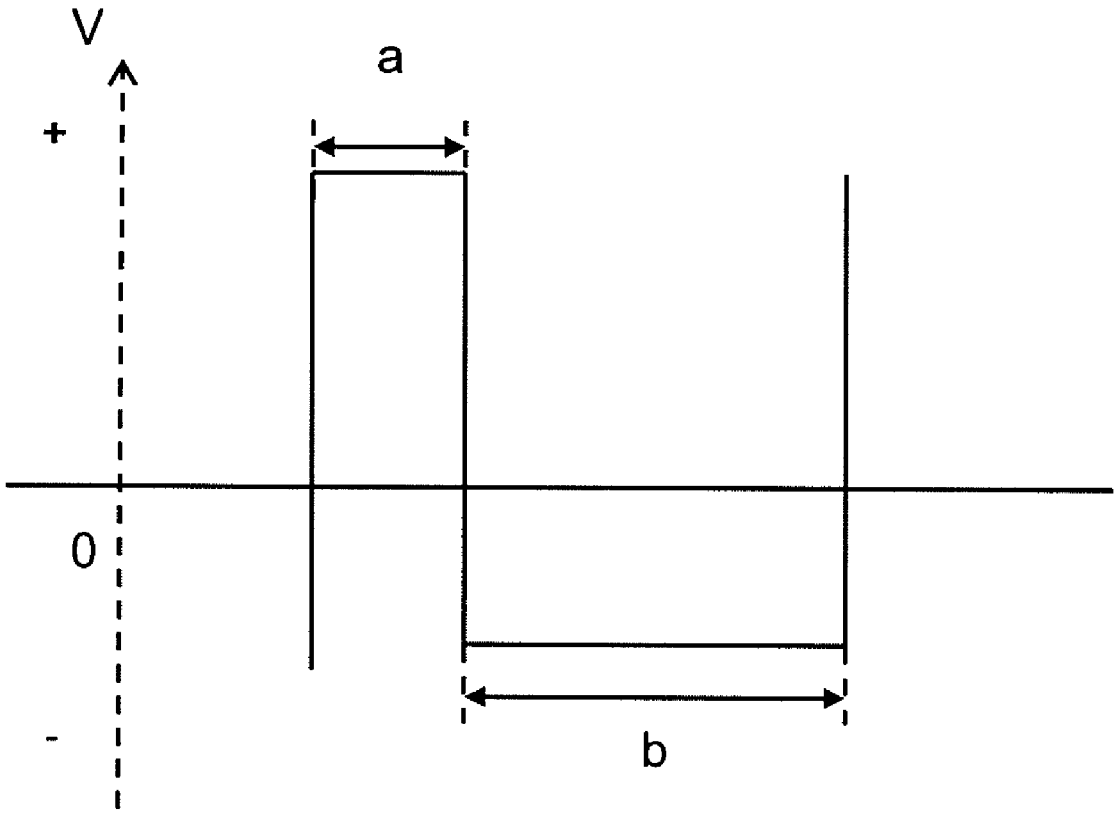
FIG. 5 is a schematic view showing the composite waveform on the development roller when the first bias is applied or on the magnetic roller when the second bias is applied.

FIG. 5 shows, for a case where, for example, positive charge toner is used and the upward and downward directions in the figure indicate positive and negative potentials respectively, the composite waveform on the development roller 22 when the first bias is applied or on the magnetic roller 23 when the second bias is applied. Here, let the period for which an electric field is applied that makes toner fly from the development roller 22 or the magnetic roller 23 be a, and let the period for which an electric field is applied that makes toner return to the development roller 22 or the magnetic roller 23 be b, then the duty ratio Dp is given by Dp={a/(a+b)}×100. That is, it is represented by the percentage of the period for which the positive potential is applied relative to the total application time. Note that when negative charge toner is used, the duty ratio is given by Dp={b/(a+b)}×100.

Next, the method of adjusting the first and the second bias will be described with reference to FIGS. 3 and 4. As described above, the first bias has a composite waveform Vslv of the DC voltage Vdc1, the AC voltage Vpp1, the duty ratio Dslv, and the frequency f. On the other hand, the second bias has a composite waveform Vmag of the DC voltage Vdc2, the AC voltage Vpp2, the duty ratio Dmag, and the frequency f. Moreover, the AC component of the second bias has the same frequency as but the opposite phase to the AC component of the first bias, and is so set as to have a duty ratio higher than that of the first bias.

The frequency f of the first bias is preferably set, for example, at 1 to 5 kHz, and, for example, to be equal to the frequency of the second AC bias. However, the duty ratio and the frequency are not particularly limited; they can be set as desired according to how the toner layer 29 is formed on the development roller 22, how an electrostatic latent image on the photoconductor drum 1*a* is developed, etc.

As shown in FIG. 3, to the development roller 22, the first bias is applied; to the magnetic roller 23, the second bias is applied superimposed on the first bias. Thus the composite waveform Vmag-Vslv applied to the magnetic roller 23 has V(max) and V(min) as shown in FIG. 4B. However, in the electric field between the development roller 22 and the magnetic roller 23, the second bias alone is applied since the first bias is canceled. In this state, the first bias alone is applied between the development roller 22 and the photoconductor drum 1*a*.

Thus, even when the bias period and the duty ratio differ between the first power supply 30 and the second power supply 31, the composite waveform of the bias formed between the development roller 22 and the magnetic roller 23 is not affected by the first bias of the first power supply 30.

On the other hand, it is also possible to superimpose the first power supply 30 on the second power supply 31. With this design, however, though the first bias alone is applied to an electric field between the development roller 22 and the magnetic roller 23 since the second bias is canceled, the first bias and the second bias are applied between the development roller 22 and the photoconductor drum 1*a*. This makes it difficult to set the first and the second bias independently, and thus to achieve uniform development.

Thus, it is preferable that the first power supply 30 of the development roller 22 and the second power supply 31 of the magnetic roller 23 be electrically connected to ground shared between them, so that the first power supply 30 and the second power supply 31 are superimposed together for the magnetic roller 23.

Figure 6:
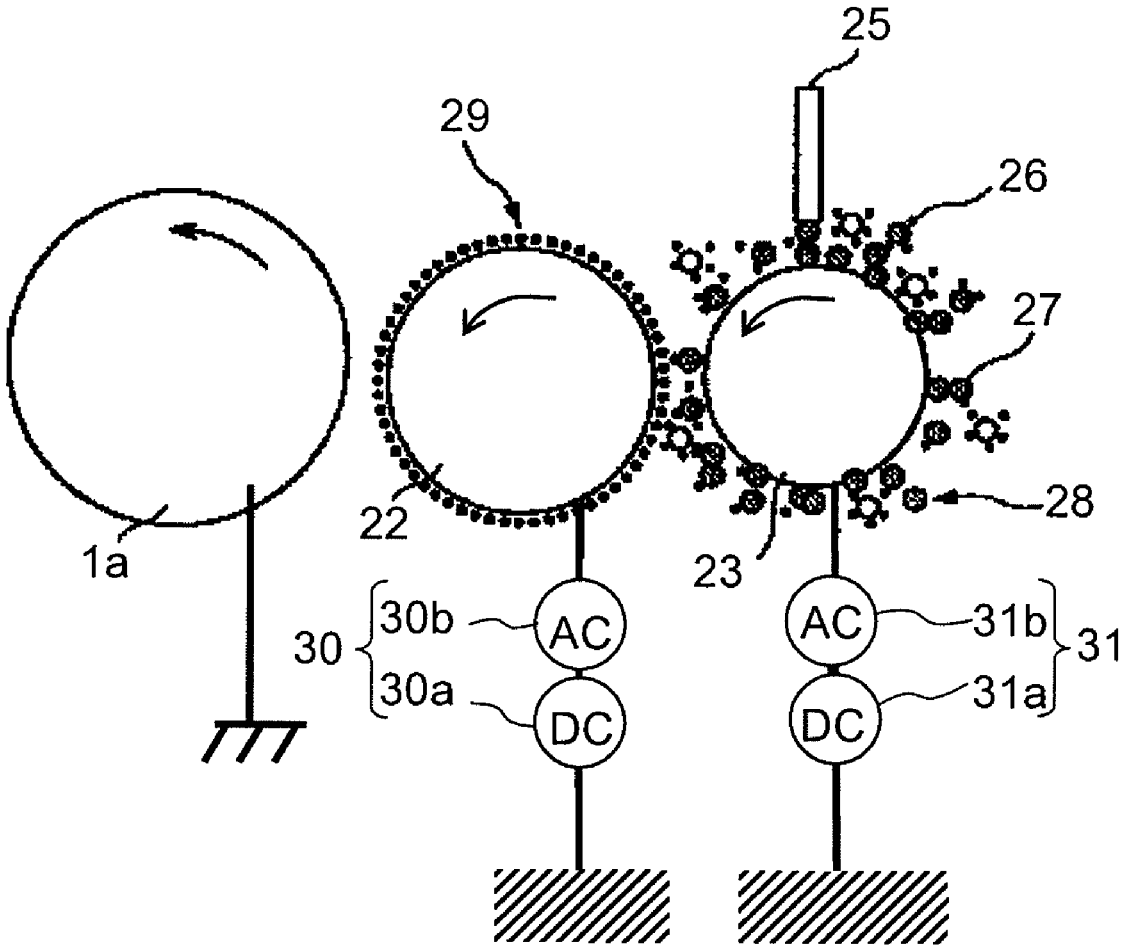
FIG. 6 is a schematic view showing how the development roller and the magnetic roller are electrically connected to separate grounds.
Figure 7A:
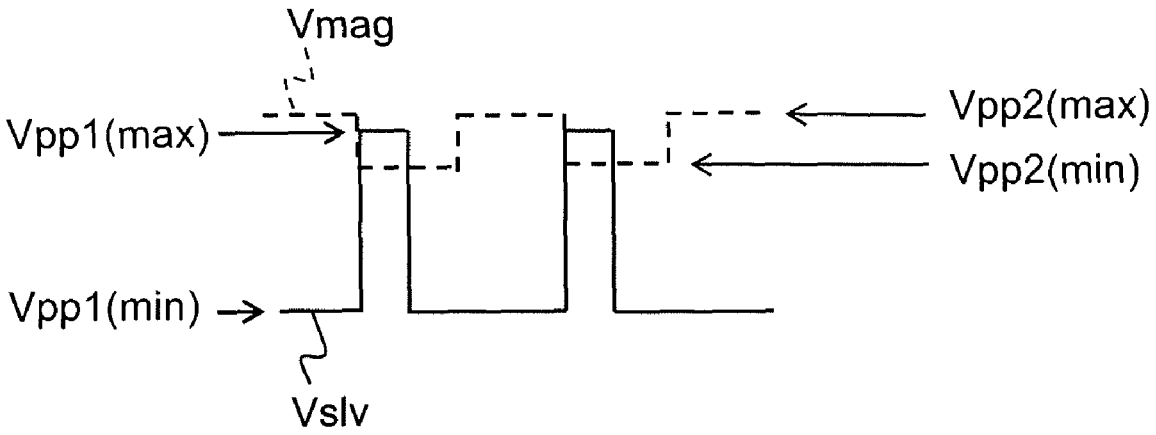
FIG. 7A is a schematic view showing the waveforms of the first and second biases applied to the development roller and the magnetic roller when they are electrically connected to separate grounds.
Figure 7B:
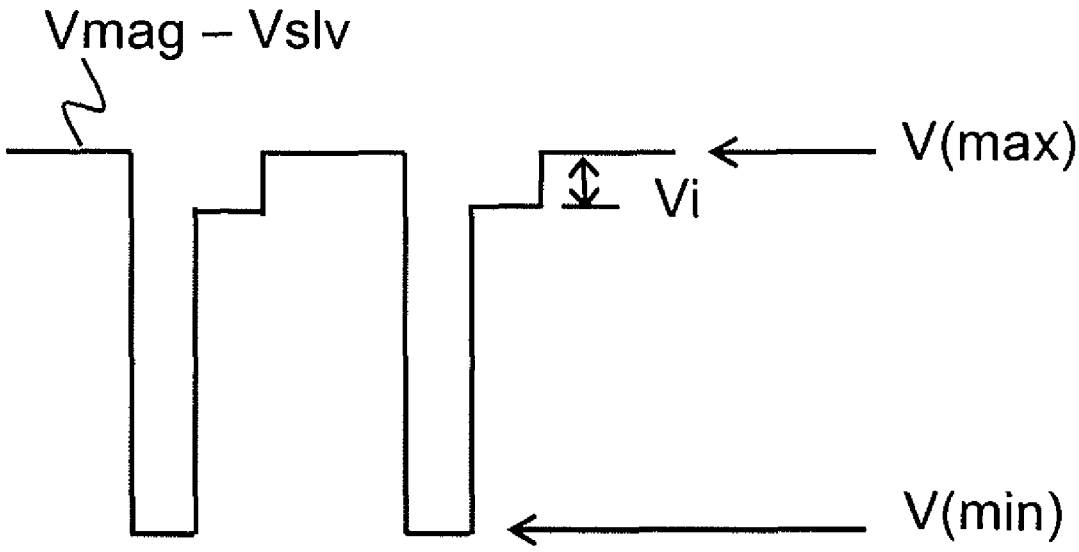
FIG. 7B is a schematic view showing the composite waveform of the first and second biases applied to the development roller and the magnetic roller when they are electrically connected to separate grounds.

As shown in FIG. 6, it is also possible to electrically connect the first and the second bias applied to the development roller 22 and the magnetic roller 23 to separate grounds. FIG. 6 is a schematic view showing how the development roller and the magnetic roller are electrically connected to separate grounds. FIG. 7A is a schematic view showing the waveforms of the first and the second bias applied to the development roller and the magnetic roller when they are electrically connected to separate grounds, and FIG. 7B is a schematic view showing the composite waveform of those biases. In FIG. 7A, the duty ratios differ between Vslv (the solid line) of the first power supply 30 and Vmag (the broken line) of the second power supply 31, and an AC bias that has the same period and frequency as but the opposite phase to Vslv is applied to Vmax.

However, when Dmag and Dslv differ in such a design, the composite waveform between the development roller 22 and the magnetic roller 23 is as shown in FIG. 7B; that is, a voltage Vi appears between Vmax and Vmin. This shortens the application period of Vmax and Vmin by the application period of Vi, and thus shortens the formation period of a toner thin layer on the development roller 22 and accordingly the collection period of undeveloped toner on the development roller 22, resulting in degraded efficiency.

Moreover, when the setting of Vpp1 of the first bias or Vpp2 of the second bias is changed, Vpp2 and Vpp1 are inevitably applied to the development roller 22 and the magnetic roller 23 respectively, and thus, when Vpp1 and Vpp2 are changed independently, it is difficult to set the biases since they affect each other.

In this embodiment, by applying the bias of the first power supply 30 to the development roller 22 and applying the bias of the second power supply 31 superimposed on the bias of the first power supply 30 to the magnetic roller 23, the composite waveform of the bias formed between the development roller 22 and the magnetic roller 23 is made equal to that of the bias of the second power supply 31, and thus is not affected by the bias of the first power supply 30 applied to the development roller 22.

Moreover, the first bias formed between the development roller 22 and the photoconductor drum 1*a* is not affected by the bias of the second power supply 31 and is controlled by the bias of the first power supply 30 alone; thus, the voltages, the duty ratios, etc. of the first and the second bias can be set independently from each other. Here, the collection of undeveloped toner from the development roller 22 to the magnetic roller 23 relies on the second bias alone.

Thus, by superimposing the second power supply 31 on the first power supply 30, it is possible to set the first bias and the second bias independently, and thus more specific setting is possible in accordance with how the toner layer 29 is formed.

Consequently, it is possible to enhance developing properties by setting the voltage and the duty ratio of the first bias large, and also to set the voltage and the duty ratio of the second bias so as to satisfactorily maintain the formation of the toner layer 29 on the development roller 22 and the collection of the toner from the development roller 22. This makes it easy to strike a proper balance between the biases to the development roller 22 and the photoconductor drum 1*a*, and between the biases to the development roller 22 and the magnetic roller 23.

When the first power supply 30 and the second power supply 31 are electrically connected to ground shared between them, as distinct from when they are electrically connected to separate grounds as shown in FIG. 7B described above, Vpp2 is not applied to the first bias. Thus, compared with the case in FIG. 7B, the absolute values of Vmax and Vmin are small, and thus the electric field that moves toner is weak. Therefore, when they are electrically connected with ground shared between them, it is preferable that Vpp1 of the first bias be larger than in a case where they are electrically connected to separate grounds.

On the other hand, if the period of application per unit time to the development roller 22 is lengthened, the collection of toner by the magnetic roller 23 may become difficult. Thus, as described previously, it is preferable that the surface of the development roller 22 be coated with, for example, a silicone-denatured urethane resin.

The development-residual toner on the development roller 22 is collected onto the magnetic roller 23 without changing the setting of the first bias applied to the development roller 22 during a non-development period from that during a development period. After the completion of development, at the time of collecting the toner from the development roller 22, when the setting of the first bias is changed from that during a development period, the potential difference between the development roller 22 and the photoconductor drum 1*a* varies at the time of changing the setting. When a variation in the potential difference occurs, the toner may fly from the development roller 22 to the photoconductor drum 1*a*, and thus a toner image having a lateral streak may be formed on the photoconductor drum 1*a*, resulting in an image failure.

Thus, the development-residual toner on the development roller 22 is collected without changing the setting of the first bias between during a non-development period and during a development period. However, if the setting of the second bias applied to the magnetic roller 23 is not changed between during a development period and during a non-development period, the toner cannot be sufficiently collected from the development roller 22; thus, of the AC components of the AC voltage Vpp2 of the second bias applied to the magnetic roller 23, the peak voltage value Vpp2 (max) at the side with the same polarity as the toner during a non-development period is made lower than during a development period.

In this way, it is possible to prevent a variation in the potential difference between the development roller 22 and the photoconductor drum 1*a* between during a development period and during a non-development period; thus, it is possible to prevent the toner from flying from the development roller 22 to the photoconductor drum 1*a* during a non-development period, and thereby to prevent the formation of a lateral streak. Note that, the non-development period includes, other than after the completion of development at the time of sequential printing operation completion, cases where development is suspended temporality halfway through continuous printing and its restarting is being waited for.

The collection of the development-residual toner from the development roller 22 to the magnetic roller 23 is affected by the balance between the peak voltage value Vpp2 (max), which is at the side with the same polarity as the toner (the side at which the toner flies from the magnetic roller 23 to the development roller 22), and the peak voltage value Vpp2 (min), which is at the side with the opposite polarity to the toner (the side at which the toner returns from the development roller 22 to the magnetic roller 23) of the AC components of the second bias applied to the magnetic roller 23. Thus, even when the formation of a lateral streak is prevented by making the first bias constant between during a development period and during a non-development period as described above, depending on the setting of the second bias applied to the magnetic roller 23, the toner on the development roller 22 may not be sufficiently collected.

When the toner is not sufficiently collected, the toner adheres on the development roller 22, and the adhered toner is charged by friction etc., resulting in image defects such as uneven images. Moreover, depending on the setting of the second bias, leakage may occur between the magnetic roller 23 and the development roller 22. Thus, by varying Vpp2 (max), the balance described above is made appropriate for collecting the toner from the development roller 22 to the magnetic roller 23.

Of the maximum voltage (the peak voltage value) Vpp2 (max) at the side with the same polarity with the toner and the minimum voltage (the peak voltage value) Vpp2 (min) at the side with the opposite polarity to the toner in Vpp2 of the second bias, the lower Vpp2 (min), the more easy it is for the toner to return from the development roller 22 to the magnetic roller 23, but the more likely leakage is to occur. Conversely, the larger Vpp2 (min), regardless of Vpp2 (max), the less likely leakage is to occur between the magnetic roller 23 and the development roller 22, but the more difficult it is for the toner to return from the development roller 22 to the magnetic roller 23. It is therefore preferable that Vpp2 (min) be set at the maximum voltage that does not exceed the leakage voltage between the development roller 22 and the photoconductor drum 1*a*.

Since the leakage voltage between the development roller 22 and the magnetic roller 23 varies according to the surface properties of the development roller 22 and the magnetic roller 23, the carrier resistance, the gap between the development roller 22 and the magnetic roller 23, etc., for example, it is possible to set the leakage voltage with these taken into consideration. Moreover, it is preferable that Vpp2 (min) be set, with the voltage fluctuation taken into consideration, at a value within the range not exceeding the leakage voltage and with a margin secured from the leakage voltage.

On the other hand, the larger Vpp2 (min) at the time of collecting the toner, the more difficult it is for the toner to return from the development roller 22 to the magnetic roller 23 as described above, and thus the higher the ratio (uncollected toner ratio) of the toner amount (second toner amount) on the development roller 22 after the collection of the development-residual toner during a non-development period to the toner amount (first toner amount) on the development roller 22 during a development period. When the uncollected toner ratio is high, the toner adheres on the development roller 22, and the adhered toner is charged by friction etc., and thus image defects may result. Moreover, the larger Vpp2 (max), the more easy it is for the toner to fly from the magnetic roller 23 to the development roller 22, and thus the higher the uncollected toner ratio.

It is therefore preferable that Vpp2 (max) be so set as to give a low uncollected toner ratio while maintaining Vpp2 (min) at a maximum value that does not exceed the leakage voltage. Thereby, the development-residual toner on the development roller 22 can be sufficiently collected while the occurrence of leakage is prevented. Though the uncollected toner ratio can be previously set through experiments etc. as desired according to image density, the material of the development roller 22, printing speed, etc., it is preferably set at, for example, 0.2% or less. In this case, by setting Vpp2 so as to give an uncollected toner ratio of 0.2% or less, it is possible to sufficiently prevent the toner from adhering on the development roller 22.

By narrowing down the conditions of Vpp2 and setting the range of Vpp2 (min) and Vpp2 (max), it is possible to obtain the compatibility of leakage prevention and printing durability and stability even when Vpp2 (min) and Vpp2 (max) are varied within this range. Thus, at the time of developing or collecting toner, it is possible to adjust Vpp2 (max) of the second bias within the range described above according to the variations in charge amount, a gap, etc., and thus to cope with different conditions flexibly.

Here, since the first and the second bias are electrically connected to ground shared between them and the second bias is applied superimposed on the first bias to the magnetic roller 23, it is possible to easily change the setting of the second bias applied to the magnetic roller 23 while keeping the first bias applied to the development roller 22 constant between during a development period and during a non-development period.

Note that the above-described development conditions are merely one example, and it is possible to set processing speed, the diameters of the development roller and the magnetic roller, the material of the development roller 22, the resistance of the carrier formed on the magnetic roller 23, etc. as desired according to the specifications of image forming devices.

Next, the operation of the developing device according to the present invention will be described with reference to FIGS. 3, 4A, and 4B. A magnetic brush 28 is formed on a magnetic roller 23 by a developer composed of charged toner 26 and a carrier 27 shown in FIG. 3, the layer of the magnetic brush 28 is regulated by an ear-breaking blade 25, and the composite waveform Vmag of the second bias shown in FIG. 4A is applied so that a toner layer 29, which is formed of the toner 26 alone, is formed on a development roller 22 by the potential difference between the magnetic roller 23 and the development roller 22.

Next, to an electrostatic latent image formed on a photoconductor drum 1*a* by exposure to light, the composite waveform Vslv of the first bias shown in FIG. 4A is applied, so that the toner 26 flies to the photoconductor drum 1*a* to achieve development, and a toner image is formed on the photoconductor drum 1*a*. Thereafter, the toner image on the photoconductor drum 1*a* is primarily transferred to an intermediate transfer belt 8, it is then secondarily transferred to transfer paper P conveyed to the intermediate transfer belt 8, and it is then fixed in a fixation part 7, and the transfer paper P is ejected.

Thereafter, without changing the setting of the first bias applied to the development roller 22 from during a development period, by varying as described above the AC component Vpp2 of the composite waveform Vmag of the second bias shown in FIG. 4B, the development-residual toner on the development roller 22 is removed to be collected onto the magnetic roller 23.

In other respects, it is to be understood that the embodiments described above are not meant to limit the present invention, which allows many variations and modifications within the scope not departing from the spirit of the invention. For example, although the embodiment above deals with, as an example, a developing device employing positive charge toner in which the charge direction is positive (plus side), it is also possible to apply the invention, similarly, to a developing device employing negative charge toner in which the charge direction is negative (minus side). In such a case, negative charge resin may be used as a coating material.

In this case, Vpp2 (max) may be set within the range not exceeding the leakage voltage described above, and the range of Vpp2 (min) may be set to provide high printing durability and stability.

Although the description above deals with, as an example, a tandem-system color image forming apparatus employing an intermediate transfer belt, so long as an image forming apparatus employs a developing unit that achieves development by making toner fly, it is also possible to apply the invention, similarly, to tandem-system color image forming apparatuses that directly transfers to a recording medium on a conveyance belt, digital multifunctional machines, analog-system monochromatic image forming apparatuses, and other image forming devices such as facsimile machines and printers.

Hereinafter, the present invention will be described in more detail by way of practical examples and a Comparative example.

PRACTICAL EXAMPLES

To a tandem-system color image forming apparatus shown in FIG. 1, developing devices 3*a* to 3*d* (see FIGS. 1 and 2) according to the above-described embodiment were incorporated; a toner layer 29 was formed on a development roller 22 under the conditions described below, was then developed on a photoconductor drum 1*a*, and was then transferred to transfer paper P.

The number average particle diameter of toner was 6 μm, the weight average particle diameter of a carrier was 35 μm, the toner charge amount was 15 μC/g, α-Si was used as the photoconductor drum 1*a*, the surface potential thereof was 350 V, the gap between the photoconductor drum 1*a* and the development roller 22 was 200 μm, and the gap between the magnetic roller 23 and the development roller 22 was 320 μm.

Practical Example 1

The first bias Vslv during a development period was set to have a duty ratio of 45%, a frequency of 4.5 kHz, with Vdc1 set at 200 V, Vpp1 (max) set at 1100 V, and Vpp1 (min) set at −700 V (Vpp1=1800 V); the second bias applied to the magnetic roller 23 was set to have a duty ratio of 70%, a frequency of 4.5 kHz, with Vdc2 set at 200 V, Vpp2 set at 1800 V, and with its AC component having the same period and frequency as but the opposite phase to the first bias.

Development was carried out with those settings, and after the completion of development, with the first and the second bias kept being applied with the same settings as during a development period, i.e. without changing the settings, the toner was collected from the development roller 22 onto the magnetic roller 23. As a result, no lateral streak on the photoconductor drum 1*a* during a non-development period was observed. That is, no flying of the toner from the development roller 22 to the photoconductor drum 1*a* resulting from the change from during a development period to during a non-development period was observed.

Comparative Example

Development was carried out under similar conditions to those for Practical example 1; after the completion of development, from the settings during a development period described above, Vpp1 (max) of the first bias was changed to 700 V, Vpp1 (min) thereof was changed to −400 V, and the second bias was kept unchanged; then the toner was collected from the development roller 22; as a result, a lateral streak was observed during a non-development period. That is, flying of the toner from the development roller 22 to the photoconductor drum 1*a* resulting from the change from during a development period to during a non-development period was observed.

Based on Practical example 1 and the Comparative example, it is found that by collecting the development-residual toner on the development roller 22 onto the magnetic roller 23 without changing the first bias applied to the development roller 22 between during a development period and during a non-development period, it is possible to prevent the formation of a lateral streak on the photoconductor drum 1*a*, and thus to prevent image failures.

However, when the settings of the second bias applied to the magnetic roller 23 are not changed between during a development period and during a non-development period, the toner is not sufficiently collected from the development roller 22. Thus, in another practical example, of the AC voltage Vpp2 of the second bias applied to the magnetic roller 23, the AC component Vpp2 (max) with the same polarity as the toner was changed between during a development period and during a non-development period.

Practical Example 2

An example of setting Vpp2 (min) of the second bias applied to the magnetic roller 23 within the range not exceeding the leakage voltage between the magnetic roller 23 and the development roller 22 will now be presented. The first bias was set to have a duty ratio of 45%, a frequency of 4.5 kHz, with Vdc1 set at 100 V, Vpp1 set at 1.8 kV (Vpp1 (max) set at 1000 V, Vpp1 (min) set at −800 V) during a development period and during a non-development period.

On the other hand, the second bias was set, during a development period, to have a duty ratio of 70%, a frequency of 4.5 kHz, with Vdc2 set at 200 V, Vpp2 set at 1.8 kV (Vpp2 (max) set at 1100 V, Vpp2 (min) set at −700 V) and development was carried out. After the completion of development, at the time of collecting the toner, as shown in Table 1, Vpp2 (min) was varied between −400 V and −1400 V, specifically among −400 V, −600 V, −800 V, −1000 V, −1200 V, and −1400 V, and Vpp2 (max) was varied between 200 V and 1000 V, specifically among 200 V, 400 V, 600 V, 800 V, and 1000 V.

Occurrence of leakage between the magnetic roller 23 and the development roller 22 at the time of collecting the development-residual toner on the development roller 22 was examined, and the results were as shown in Table 1. In Table 1, "OK" indicates that no leakage occurred, and "NG" indicates that leakage occurred.

TABLE 1

| Vpp2(max) | Vpp2(min) (V) | | | | | |
|---|---|---|---|---|---|---|
| (V) | −400 | −600 | −800 | −1000 | −1200 | −1400 |
| 1000 | OK | OK | OK | OK | NG | NG |
| 800 | OK | OK | OK | OK | NG | NG |
| 600 | OK | OK | OK | OK | NG | NG |
| 400 | OK | OK | OK | OK | NG | NG |
| 200 | OK | OK | OK | OK | NG | NG |

According to the results, when Vpp2 (min) was −1200 V or lower, leakage occurred between the magnetic roller 23 and the development roller 22, whereas when Vpp2 (min) was −1000 V or higher, no leakage was observed regardless of Vpp2 (max). Moreover, no lateral streak was observed. Thus, it is found that Vpp2 (min) may be set within the range of −1000 V or higher under the bias setting conditions described above.

Practical Example 3

An example of setting Vpp2 (min) of the second bias applied to the magnetic roller 23 will now be presented. Under similar bias conditions to those for Practical example 2, the toner layer 29 was formed on the development roller 22 from the magnetic roller 23, an electrostatic latent image formed on the photoconductor drum 1*a* was then developed, and after the completion of development, the development-residual toner on the development roller 22 was collected.

Then, based on the first toner amount A1 during a development period and the second toner amount A2 after collecting the development-residual toner after the completion of development, the uncollected toner ratio=A2/A1×100(%) was examined, and the results were as shown in Table 2. Note that if the uncollected toner ratio exceeds 0.2%, the toner adheres on the development roller 22, which may affect the stability of withstand voltage; thus it is preferable that the uncollected toner ratio be 0.2% or lower. The results are shown in Table 2.

TABLE 2

| Vpp2(max) | Vpp2(min) (V) | | | | | |
|---|---|---|---|---|---|---|
| (V) | −400 | −600 | −800 | −1000 | −1200 | −1400 |
| 1000 | — | — | — | 0.33 | 0.12 | 0.08 |
| 800 | — | — | 0.48 | 0.19 | 0.11 | 0.08 |
| 600 | — | 0.51 | 0.43 | 0.18 | 0.10 | 0.07 |
| 400 | 0.58 | 0.45 | 0.41 | 0.15 | 0.10 | 0.07 |
| 200 | 0.48 | 0.38 | 0.30 | 0.13 | 0.10 | 0.05 |

According to the results, when Vpp2 (min) was −800 V or higher, regardless of Vpp2 (max), the uncollected toner ratio was 0.30% or higher. On the other hand, when Vpp2 (min) was −1200 V or lower, regardless of Vpp2 (max), the uncollected toner ratio was 0.12% or lower. When Vpp2 (min) was −1000 V, the uncollected toner ratio was 0.19% or lower when Vpp2 (max) was 800 V or lower but was 0.33% when Vpp2 (max) was 1000 V. Moreover, no lateral streak was formed on the development roller 22 during a non-development period.

Thus, it is found that, when Vpp2 (min) is −1200 V or lower or when Vpp2 (min) is −1000 V and Vpp2 (max) is 800 V or lower, the uncollected toner ratio is 0.2% or lower, with the result that adhesion of the toner on the development roller 22 is prevented and printing durability and stability is not affected.

Therefore, when the results of Practical examples 2 and 3 are considered together, the maximum Vpp2 (min) at which no leakage occurs is −1000 V, and Vpp2 (max) at which the uncollected toner ratio is 0.2% or lower is within the range of 800 V or lower. Thus, it is found that by setting Vpp2 (min) at −1000 V and Vpp2 (max) within the range of 800 V or lower, it is possible to obtain the compatibility of leakage prevention and printing durability and stability under the bias setting conditions described above.

In Practical example 3, though the results in Table 2 were obtained by varying Vpp2 (min) in increments of 200 V, there may be cases where the value of the uncollected toner ratio is 0.2% or lower within the range in which Vpp2 (min) is over −1200 V but below −800 V centering around −1000 V. In addition, based on Table 1 of Practical example 2, no leakage may occur within the range. Thus, when there is a range in which the uncollected toner ratio is 0.2% or lower, it is possible to vary Vpp2 (min) as desired within that range.

According to the present invention, after the completion of development, at the time of collecting development-residual toner on a toner carrying member, no variation in the first bias is caused by the change between during a development period and during a non-development period; thus, no variation occurs in the potential difference between the toner carrying member and an image carrying member, and flying of the toner from the toner carrying member to the image carrying member at the time of the change can be prevented. Thus, it is possible to prevent the formation of a lateral streak on the image carrying member during a non-development period, and thus to prevent degradation in image quality.

Moreover, the second bias application device is electrically connected to ground shared with the first bias application device, and the second bias superimposed on the first bias is applied to a toner feeding member. This makes it possible to set the first bias and the second bias independently without affecting each other, and thus makes it easy to set the first and the second bias.

Of the AC components of the second bias, the peak voltage value at the side with the opposite polarity to the toner is kept within the range not exceeding the leakage voltage between the toner feeding member and the toner carrying member, and on the other hand the peak voltage value at the side with the same polarity as the toner is so adjusted that the ratio of the second toner amount to the first toner amount is equal to or less than a predetermined value. This makes it possible to stably form a toner layer on the toner carrying member, and also makes it possible to sufficiently collect the toner from the toner carrying member and thereby prevent degradation in printing durability and stability.

Of the AC components of the second bias, the peak voltage value at the side with the opposite polarity to the toner is kept at a maximum value within the range not exceeding the leakage voltage between the toner feeding member and the toner carrying member. This makes it easy for the toner to return from the toner carrying member to the toner feeding member. Moreover, by employing the above developing device in image forming devices, it is possible to perform image formation in which image failures such as the formation of a lateral streak are prevented.

What is claimed is:

1. A developing device comprising:

a toner carrying member which is disposed to face an image carrying member and which develops an electrostatic latent image on a surface of the image carrying member;

a toner feeding member which forms a toner layer on the toner carrying member by use of a magnetic brush;

a first bias application device which applies a first bias composed of DC and AC components to the toner carrying member; and a second bias application device which applies a second bias composed of DC and AC components to the toner feeding member, the second bias being settable independently of the first bias wherein a two-component developer containing at least a carrier and toner is used, and the first and second bias application devices apply the first and second biases as development biases to the toner carrying member and the toner feeding member so as to develop the electrostatic latent image on the surface of the image carrying member, wherein during a non-development period, the first bias remains unchanged from during a development period, and of the AC components of the second bias, a peak voltage value at a same polarity as the toner is made lower than during the development period so as to collect development-residual toner on the toner carrying member onto the toner feeding member, and wherein, when a toner amount on the toner carrying member during a development period is a first toner amount and a toner amount on the toner carrying member after collection of the development-residual toner during a non-development period is a second toner amount, of the AC component of the second bias, a peak voltage value at an opposite polarity to the toner is kept within a range not exceeding a leak voltage between the toner feeding member and the toner carrying member, and the peak voltage value at the side with the same polarity as the toner is so adjusted that a ratio of the second toner amount to the first toner amount is equal to or less than a predetermined value.

2. A developing device comprising:

a toner carrying member which is disposed to face an image carrying member and which develops an electrostatic latent image on a surface of the image carrying member;

a toner feeding member which forms a toner layer on the toner carrying member by use of a magnetic brush;

a first bias application device which applies a first bias composed of DC and AC components to the toner carrying member; and a second bias application device which applies a second bias composed of DC and AC components to the toner feeding member, the second bias being settable independently of the first bias wherein a two-component developer containing at least a carrier and toner is used, and the first and second bias application devices apply the first and second biases as development biases to the toner carrying member and the toner feeding member so as to develop the electrostatic latent image on the surface of the image carrying member, wherein during a non-development period, the first bias remains unchanged from during a development period, and of the AC components of the second bias, a peak voltage value with a same polarity as the toner is made lower than during the development period so as to collect development-residual toner on the toner carrying member onto the toner feeding member, wherein the second bias application device is electrically connected to ground shared with the first bias application device, and the second bias superimposed on the first bias is applied to the toner feeding member, and wherein, when a toner amount on the toner carrying member during a development period is a first toner amount and a toner amount on the toner carrying member after collection of the development-residual toner during a non-development period is a second toner amount, of the AC component of the second bias, a peak voltage value at an opposite polarity to the toner is kept within a range not exceeding a leak voltage between the toner feeding member and the toner carrying member, and the peak voltage value at the side with the same polarity as the toner is so adjusted that a ratio of the second toner amount to the first toner amount is equal to or less than a predetermined value.

3. The developing device according to claim 1, wherein the peak voltage value at the side with the opposite polarity to the toner is kept at a maximum value within the range not exceeding the leakage voltage between the toner feeding member and the toner carrying member.

4. The developing device according to claim 2, wherein the peak voltage value at the side with the opposite polarity to the toner is kept at a maximum value within the range not exceeding the leakage voltage between the toner feeding member and the toner carrying member.

5. An image forming apparatus comprising the developing device according to claim 1.

6. An image forming apparatus comprising the developing device according to claim 2.

7. An image forming apparatus comprising the developing device according to claim 3.

8. An image forming apparatus comprising the developing device according to claim 4.

* * * * *